US008573401B2

(12) United States Patent
Taneda

(10) Patent No.: US 8,573,401 B2
(45) Date of Patent: Nov. 5, 2013

(54) PACKAGING BOX CLOSING MEMBER

(75) Inventor: Satoshi Taneda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 112 days.

(21) Appl. No.: 13/096,553

(22) Filed: Apr. 28, 2011

(65) Prior Publication Data

US 2012/0080349 A1 Apr. 5, 2012

(30) Foreign Application Priority Data

Oct. 5, 2010 (JP) ..... 2010-225846

(51) Int. Cl.

| | |
|---|---|
| ***B65D 85/62*** | (2006.01) |
| ***B65D 19/00*** | (2006.01) |
| ***B65D 79/00*** | (2006.01) |
| ***B65D 19/38*** | (2006.01) |

(52) U.S. Cl.

USPC ..... 206/508; 206/386; 206/503; 206/752; 108/53.1; 108/57.16

(58) Field of Classification Search

USPC ..... 206/386, 503, 508, 557, 595, 596, 597, 206/598, 599, 600, 730, 732, 735, 736, 752, 206/767, 831, 45.2, 45.21, 45.24, 45.25, 206/45.28, 45.29, 768; 229/125, 125.28, 229/915; 108/53.1, 57.16

See application file for complete search history.

(56) References Cited

U.S. PATENT DOCUMENTS

| | | | | |
|---|---|---|---|---|
| 1,075,839 | A * | 10/1913 | Matthews | 206/45.29 |
| 1,454,860 | A * | 5/1923 | Relihan | 206/750 |
| 1,658,102 | A * | 2/1928 | Snyder | 206/557 |
| 1,665,620 | A * | 4/1928 | Amatel | 206/732 |
| 2,620,117 | A * | 12/1952 | Nemoede | 229/120.32 |
| 2,823,794 | A * | 2/1958 | Garman | 206/752 |
| 3,163,290 | A * | 12/1964 | Shive | 206/526 |
| 4,763,607 | A * | 8/1988 | Tominaga | 119/452 |
| 5,007,530 | A * | 4/1991 | Weismantel | 206/45.21 |
| 5,285,915 | A * | 2/1994 | Earl | 217/56 |
| 5,524,816 | A * | 6/1996 | Zriny | 229/125 |
| 5,547,073 | A * | 8/1996 | Smith | 206/45.24 |
| 5,718,338 | A * | 2/1998 | Yucknut et al. | 206/736 |
| 2003/0146224 | A1* | 8/2003 | Fujii et al. | 220/592.27 |
| 2006/0053754 | A1* | 3/2006 | Carrigan et al. | 53/589 |

FOREIGN PATENT DOCUMENTS

JP 2006-232282 A 9/2006

* cited by examiner

*Primary Examiner* — J. Gregory Pickett
*Assistant Examiner* — Javier A Pagan
(74) *Attorney, Agent, or Firm* — Sughrue Mion, PLLC

(57) ABSTRACT

A packaging box closing member includes a flat panel portion that is placed on a pair of unsealed lid portions of a packaging box so as to intersect a closed portion formed by the pair of lid portions, the pair of lid portions being located on a top surface of the packaging box; and an upright portion that stands on a side of the flat panel portion, the side intersecting the closed portion, wherein, when stacking another packaging box on the top surface of the packaging box, a part of the another packaging box or a part of a transport device that transports the another packaging box contacts the upright portion, and the packaging box closing member is pushed toward an end of the top surface of the packaging box together with the flat panel portion and is dropped.

1 Claim, 8 Drawing Sheets

PACKAGING BOX CLOSING MEMBER

CROSS-REFERENCE TO RELATED APPLICATIONS

This application is based on and claims priority under 35 USC 119 from Japanese Patent Application No. 2010-225846 filed Oct. 5, 2010.

BACKGROUND (i) Technical Field

The present invention relates to a packaging box closing member.

(ii) Related Art

When storing electronic apparatuses in a warehouse or the like, the electronic apparatuses are usually packed in packaging boxes, such as corrugated cardboard boxes.

In general, a corrugated cardboard box used as a packaging box includes a body portion, a top surface, and a bottom surface. The body portion is a hollow rectangular box that is made by bonding a flap formed on a side panel at one end to a side panel at the other end. The top and bottom surfaces are formed by a pair of lid portions of side panels.

In order to increase space utilization of a warehouse or the like, such packaging boxes containing electronic apparatuses may be stacked in two or three tiers.

In order to allow inspection and initial setting of the electronic apparatuses before shipping the electronic apparatuses or in order to allow additional packaging of accessories and the like, the packaging box may be stored in a warehouse or the like without sealing the lid portions on the top surfaces of the packaging box by using an adhesive tape or the like.

In such a case, the lid portions on the top surfaces of the packaging box may be opened when stacking another packaging box on the packaging box, thereby hindering the operation of stacking the other packaging box.

SUMMARY

According to an aspect of the invention, a packaging box closing member includes a flat panel portion that is placed on a pair of unsealed lid portions of a packaging box so as to intersect a closed portion formed by the pair of lid portions, the pair of lid portions being located on a top surface of the packaging box; and an upright portion that stands on a side of the flat panel portion, the side intersecting the closed portion, wherein, when stacking another packaging box on the top surface of the packaging box, a part of the another packaging box or a part of a transport device that transports the another packaging box contacts the upright portion, and the packaging box closing member is pushed toward an end of the top surface of the packaging box together with the flat panel portion and is dropped.

BRIEF DESCRIPTION OF THE DRAWINGS

Exemplary embodiments of the present invention will be described in detail based on the following figures, wherein.

DETAILED DESCRIPTION

Figure 1:
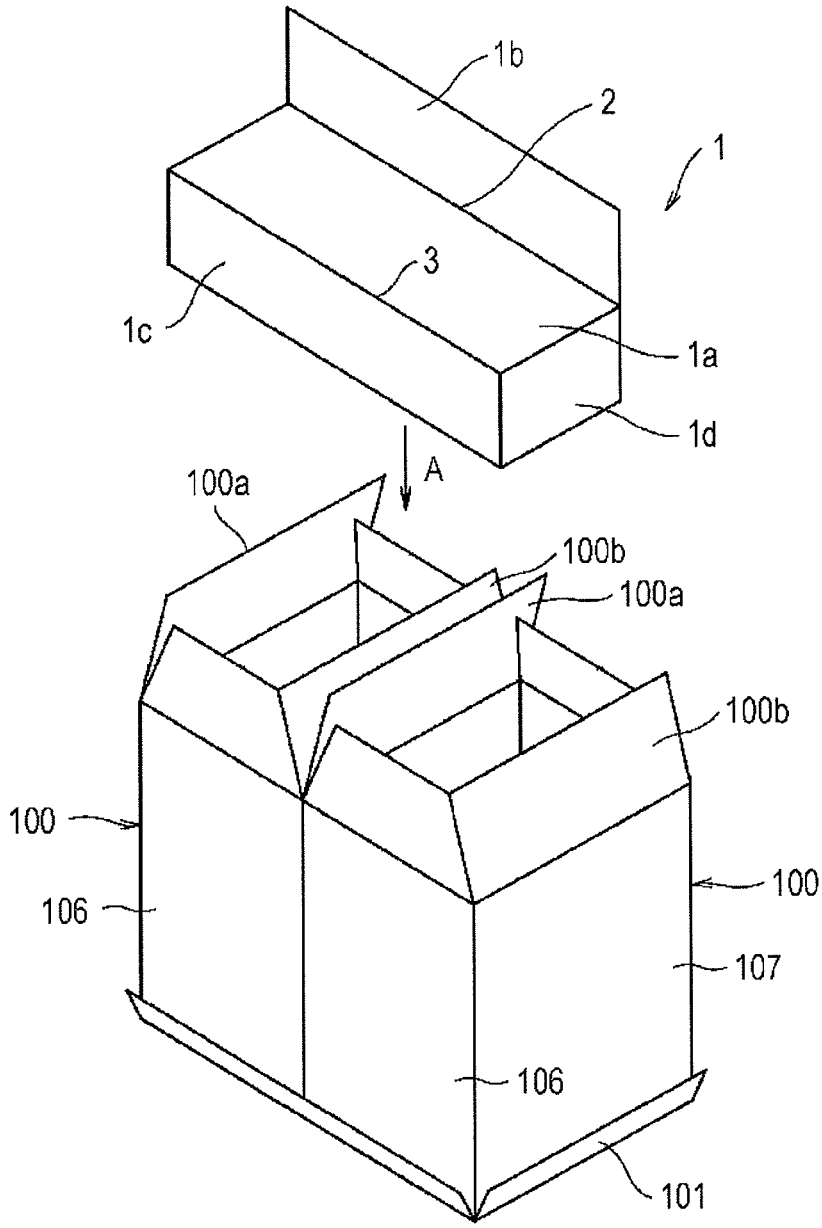
FIG. 1 is a perspective view of an example of a packaging box closing member according to an exemplary embodiment.

Hereinafter, an exemplary embodiment of the present invention will be described with reference to the drawings. In the drawings, the same members are denoted by the same numerals, and redundant description will be omitted. The present invention is not limited to the exemplary embodiment.

Figure 10:
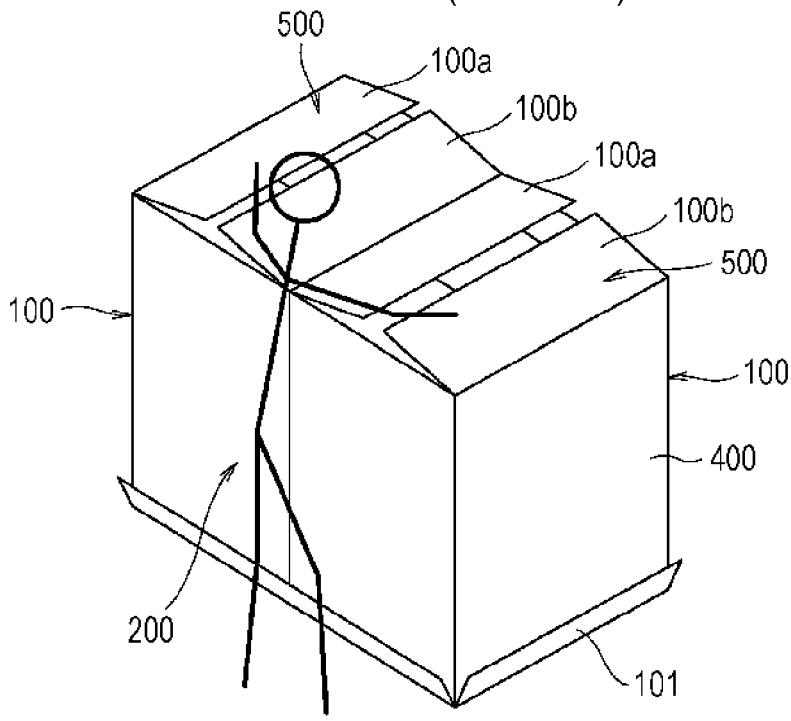
FIG. 10 (Related Art)
FIG. 10 is a perspective view of a comparative example.
Figure 11:
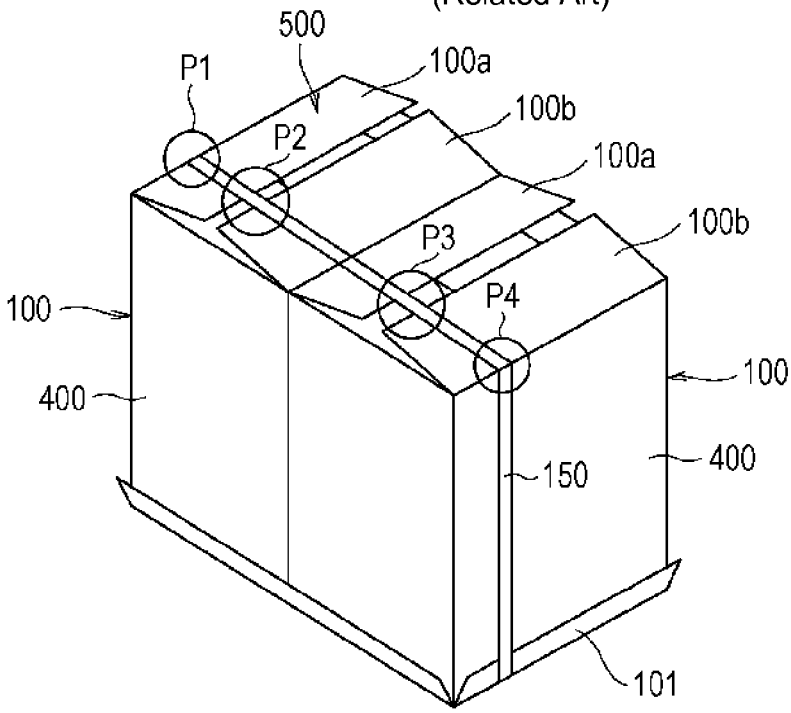
FIG. 11 (Related Art)
FIG. 11 is a perspective view of the comparative example.

Referring to FIGS. 10 and 11, a comparative example will be described before describing a packaging box closing member according to the exemplary embodiment of the present invention.

A packaging box 100, which is a corrugated cardboard box, includes a body portion 400, a bottom surface (not shown), and a top surface 500 (see FIG. 10 and other figures). The body portion 400 is a hollow rectangular box that is made by bonding a flap formed on a side panel at one end to a side panel at the other end. The bottom surface and the top surface 500 are formed by a pair of lid portions 100*a* and 100*b* of side panels.

Figure 6:
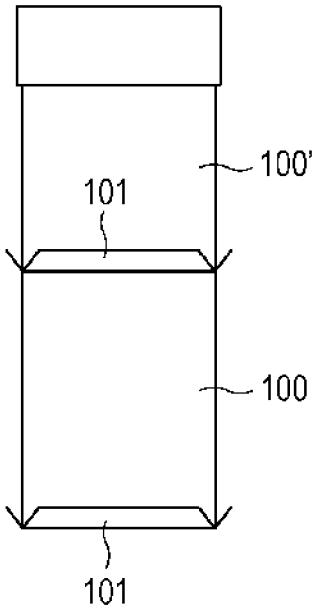
FIG. 6 illustrates the next step of using the packaging box closing member according to the exemplary embodiment.

In order to increase the space utilization of a warehouse or the like, plural packaging boxes 100, which contain electronic apparatuses and the like, may be stacked in two or three tiers (see FIG. 6).

In order to allow inspection and initial setting before shipping electronic apparatuses or in order to allow additional packaging of accessories and the like, the packaging box 100 may be stored in a warehouse or the like without sealing the lid portions (flap portions) 100*a* and 100*b* on the top surface 500 of the packaging box 100 by using an adhesive tape or the like.

In such a case, the lid portions 100*a* and 100*b* on the top surface 500 of the packaging box 100 may be opened when stacking another packaging box 100 on the packaging boxes 100, whereby the lid portions 100*a* and 100*b* may be damaged or the lid portions 100*a* and 100*b* may hinder the operation of stacking the other packaging box 100.

To prevent this, for example, as illustrated in FIG. 10, an operator 200 may press the lid portions 100*a* and 100*b* on the top surface 500 of the packaging box 100 by his/her hand to prevent the lid portions 100*a* and 100*b* from being opened, and then other packaging boxes are stacked by using a transport device such as a forklift truck. In this case, it is necessary to ensure the safety of the operator 200.

Instead, a weight may be placed on the lid portions 100*a* and 100*b* on the top surface 500 of the packaging box 100. In this case, the weight may hinder the stacking operation, thereby decreasing the workability.

As illustrated in FIG. 11, a polypropylene band (PP band) 150 may be wrapped around an end portion of the packaging box 100 and temporarily fastened so that the lid portions 100*a* and 100*b* on the top surface 500 of the packaging box 100 may not be opened, and then the other packaging box may be stacked by using a transport device such as a forklift truck.

In this case, however, the packaging box 100 may be dented or cut at positions P1 to P4 illustrated in FIG. 11.

To address the above-described problems, the inventor has carried out a study and conceived an idea of a packaging box closing member according to the present invention.

Referring to FIGS. 1 to 9B, a packaging box closing member 1 according to the present invention will be described.

Figure 2:
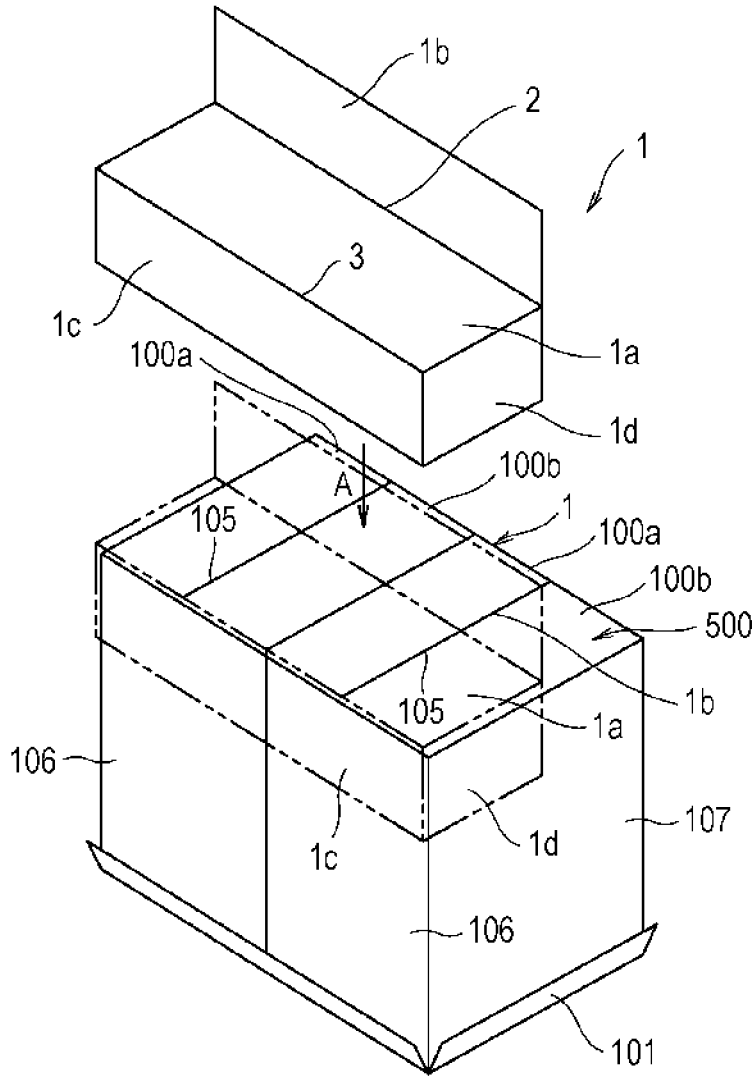
FIG. 2 illustrates how the packaging box closing member according to the exemplary embodiment is used.

FIGS. 1 and 2 illustrate an example in which two packaging boxes 100 are arranged on a base 101, two other packaging boxes 100' are stacked on the packaging boxes 100, and the packaging box closing member 1 is applied to this stack. However, the form of the stack of packaging boxes is not limited thereto, and the packaging box closing member 1 may be applied to a stack that includes only one packaging box 100 and another packaging box 100' stacked thereon.

The packaging box closing member 1 according to the present exemplary embodiment is a member that closes the pair of lid portions 100*a* and 100*b* on the top surface of the packaging box 100 when stacking the other packaging box 100' before the packaging box 100 is sealed with an adhesive tape or the like.

The packaging box closing member 1 includes a flat panel portion 1*a* and an upright portion 1*b*. The flat panel portion 1*a* is placed on the pair of lid portions 100*a* and 100*b* of the packaging box 100 that are closed and unsealed, so that the flat panel portion 1*a* extends in a direction that intersects (in the example illustrated in FIG. 2, perpendicularly intersects) a closed portion 105 (see FIG. 2) formed by the pair of lid portions 100*a* and 100*b*. The upright portion 1*b* stands on a side 2 of the flat panel portion 1*a* that intersects the closed portion 105. The shape of the closed portion 105 may be linear or wave-shaped.

When stacking the other packaging box 100' on the top surface 500 of the packaging box 100 (see FIG. 3), a part of the other packaging box 100' or a part (for example, a tip 300*a* of a fork 300) of a forklift truck F (an example of a transport device) that transports the packaging box 100' contacts the upright portion 1*b*, and the packaging box closing member is pushed toward an end of the top surface 500 of the packaging box 100 (in the direction of arrow B in FIGS. 4 and 5) together with the flat panel portion 1*a* and is dropped.

In the example illustrated in FIGS. 1 and 2, the length of the flat panel portion 1*a* of the packaging box closing member 1 is the same as the sum of the widths of the two packaging boxes 100. However, the length of the flat panel portion 1*a* is not limited thereto, and may be a length that allows the flat panel portion 1*a* to intersect the closed portion 105 formed by the lid portions 100*a* and 100*b* (that is, a length that allows the flat panel portion 1*a* to straddle the closed portion 105).

A drooping portion 1*c* is disposed on a side 3 of the flat panel portion 1*a* opposite to the upright portion 1*b*. When the flat panel portion 1*a* is placed on the top surface 500 of the packaging box 100, the drooping portion 1*c* droops along a side surface 106 of the packaging box 100.

In the example illustrated in FIGS. 1 and 2, the packaging box closing member 1 includes side panel portions 1*d* on both sides thereof. However, the side panel portions 1*d* may be omitted.

A support portion that supports the upright portion 1*b* to prevent the upright portion 1*b* from being folded toward the flat panel portion 1*a* may be disposed between the flat panel portion 1*a* and the upright portion 1*b* (specific examples will be described below with reference to FIGS. 7A to 9B).

A weight member 1*f* for preventing the pair of lid portions 100*a* and 100*b* on the top surface 500 of the packaging box 100 from being lifted may be disposed on the flat panel portion 1*a*. Alternatively, the total weight of the packaging box closing member 1 may be heavy enough to prevent the lid portions 100*a* and 100*b* from being lifted. The weight member may also serve as the support portion.

As described below, the portions of the packaging box closing member 1 may be formed by cutting and folding corrugated paper. The material of the packaging box closing member 1 is not limited to corrugated paper, and may be a resin such as a plastic.

Referring to FIGS. 1 to 6, how to use the packaging box closing member 1 according to the present exemplary embodiment will be described.

First, an operator holds the packaging box closing member 1 in such a manner that the drooping portion 1*c* and the side panel portions 1*d* are on a lower side, and lowers the packaging box closing member 1 toward the top surface 500 of the packaging box 100 in the direction of arrow A. Then, the operator places the packaging box closing member 1 on the packaging box 100 in such a manner that, as illustrated in FIG. 2, the flat panel portion 1*a* is placed on the lid portions 100*a* and 100*b* on the top surface 500, the drooping portion 1*c* contacts a front surface (a side surface) 106 of the packaging box 100, and the side panel portions 1*d* contact side surfaces of the packaging box 100.

Thus, the lid portions 100*a* and 100*b* are closed under the weight of the packaging box closing member 1, even if the operator does not press the lid portions 100*a* and 100*b*.

Figure 3:
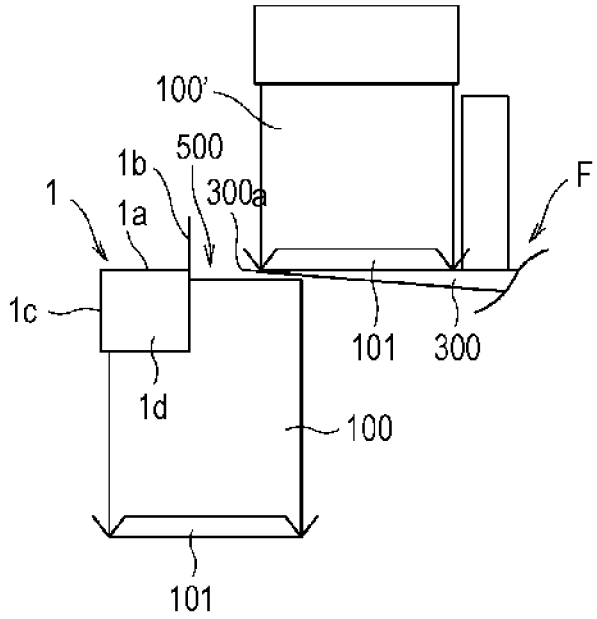
FIG. 3 illustrates the steps for using the packaging box closing member according to the exemplary embodiment.

Next, as illustrated in FIG. 3, an operation of stacking the other packaging box 100' on the packaging box 100 is started.

As illustrated in FIG. 3, the packaging box 100' is placed on the fork 300 of the forklift truck F and transported to a position above a side of the packaging box 100 on which the packaging box closing member 1 is not placed.

Figure 4:
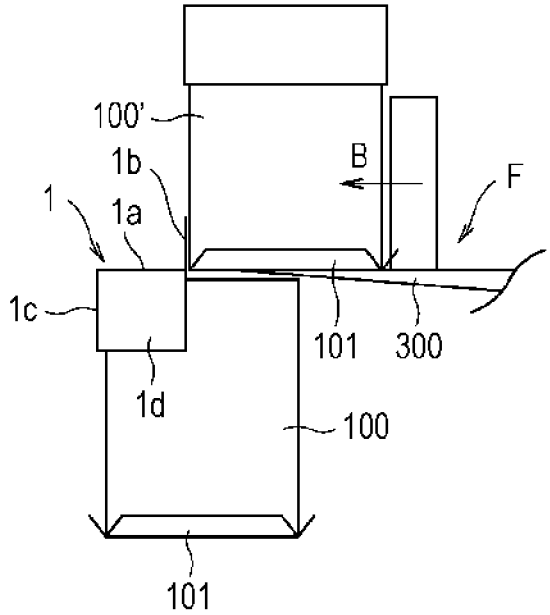
FIG. 4 illustrates a step of using the packaging box closing member according to the exemplary embodiment.

Next, as illustrated in FIG. 4, the forklift truck F is operated to gradually move the packaging box 100' in the direction of arrow B.

After a lower front end portion of the packaging box 100' contacts the upright portion 1*b* of the packaging box closing member 1, as the packaging box 100' moves in the direction of arrow B, the packaging box closing member 1 is pushed in the direction of arrow B (toward an end of the top surface 500).

Figure 5:
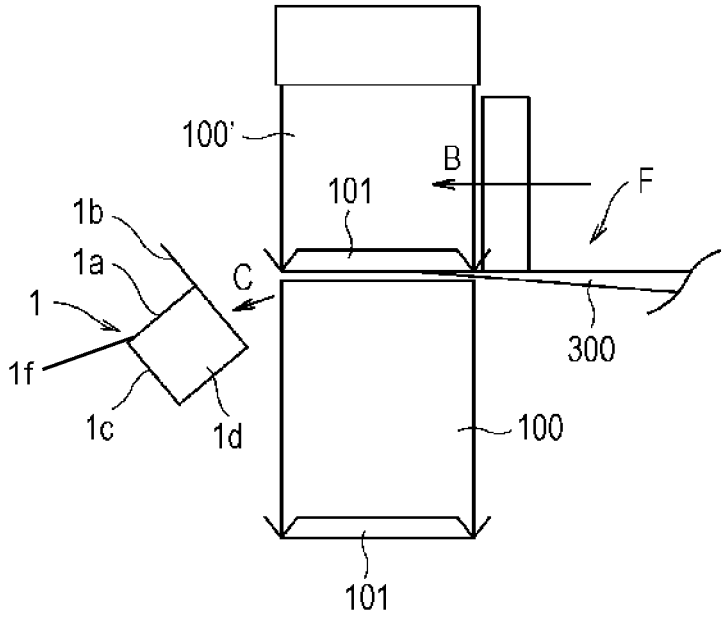
FIG. 5 illustrates the next step of using the packaging box closing member according to the exemplary embodiment.

When the packaging box closing member 1 is further pushed in the direction of arrow B (toward the end of the top surface 500), the packaging box closing member 1 drops from the packaging box 100 under its own weight in the direction of arrow C (as illustrated in FIG. 5).

Next, the forklift truck F is operated to remove the fork 300 in a direction opposite to that of arrow B, and the packaging box 100' is stacked on the packaging box 100 as illustrated in FIG. 6, whereby the stacking operation is finished.

Thus, with the packaging box closing member 1 according to the present exemplary embodiment, all an operator has to do is to place the packaging box closing member 1 on the packaging box 100, and the operator need not press the lid portions 100*a* and 100*b* by his/her hand. Moreover, the packaging box closing member 1 drops under its own weight while the packaging box 100' is being placed on the packaging box 100. As a result, the operational efficiency is improved.

Referring to FIGS. 7A to 9B, examples of the packaging box closing member made of corrugated paper will be described.

In FIGS. 7A to 9B, which are developed views of the packaging box closing member, solid lines represent "cutting lines", alternate long and short dash lines represent "outward fold lines", and broken lines represent "inward fold lines".

Figure 7A:
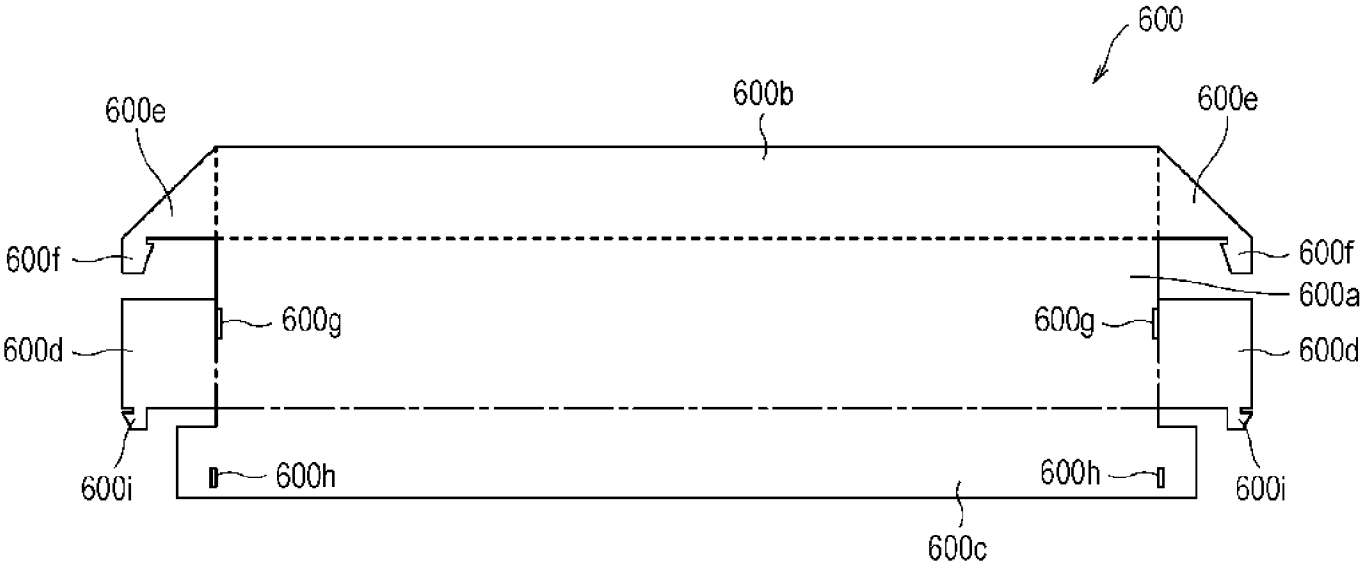
FIG. 7A is a developed view and FIG. 7B is a perspective view of an example of the packaging box closing member according to the exemplary embodiment.

FIG. 7A is a developed view of a packaging box closing member 600 in which an upright portion 600*b* is formed on one of the long sides of a rectangular flat panel portion 600*a*, support portions 600*e* are formed at the left and right ends of the upright portion 600*b*, and each of the support portions 600*e* has an insertion flap 600*f*.

Side panel portions 600*d* are formed at the left and right ends of the flat panel portion 600*a*, and each of the side panel portions 600*d* has an insertion flap 600*i*.

Insertion slits 600*g*, into which the insertion flaps 600*f* are to be inserted, are formed near the boundaries between the flat panel portion 600*a* and the side panel portions 600*d*.

A drooping portion 600*c* is formed on the other of the long sides of the flat panel portion 600*a*, and insertion slits 600*h*, into which the insertion flaps 600*i* are to be inserted, are formed in the drooping portion 600*c*.

Figure 7B:
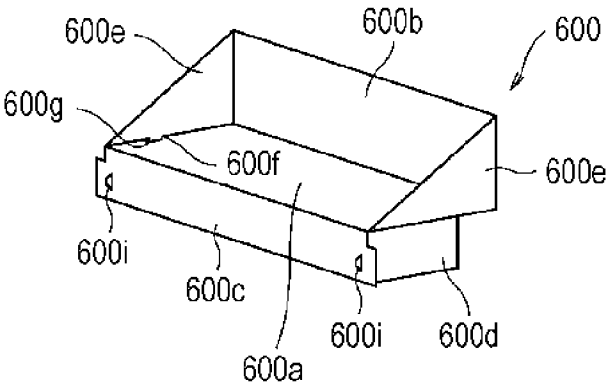

FIG. 7B is a perspective view of the packaging box closing member 600 that is made by folding the above-described corrugated paper along the alternate long and short dash lines and the broken lines and by inserting the insertion flaps 600*f* and 600*i* into the insertion slits 600*g* and 600*h*.

As necessary, a weight member may be disposed on the flat panel portion 600*a*.

Figure 8A:
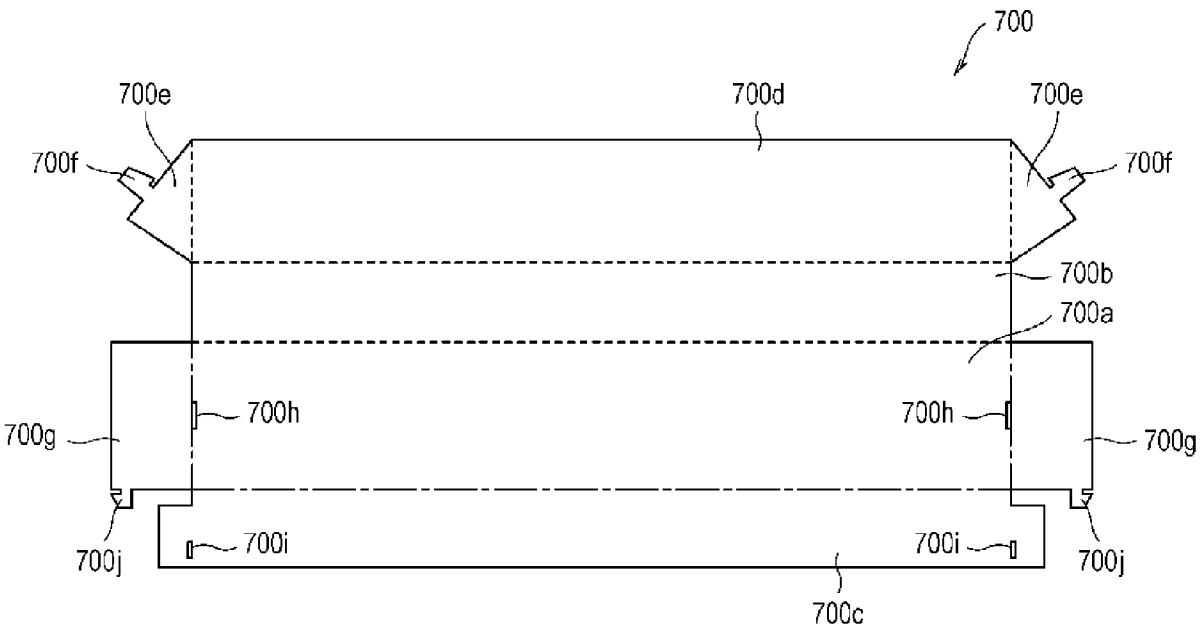
FIG. 8A is a developed view and FIG. 8B is a perspective view of an example of the packaging box closing member according to the exemplary embodiment.

FIG. 8A is a developed view of a packaging box closing member 700 in which an upright portion 700*b* is formed on one of the long sides of a rectangular flat panel portion 700*a*, and a support portion 700*d* that supports the upright portion 700*b* when the packaging box closing member 700 is assembled is disposed on the upright portion 700*b*.

Side wall portions 700*e* that support the upright portion 700*b* when the packaging box closing member 700 is set up are formed at the left and right ends of the support portion 700*d*, and each of the side wall portions 700*e* has an insertion flap 700*f*.

Side panel portions 700*g* are formed at the left and right ends of the flat panel portion 700*a*, and each of the side panel portions 700*g* has an insertion flap 700*j*.

Insertion slits 700*h*, into which the insertion flaps 700*f* are to be inserted, are formed near the boundaries between the flat panel portion 700*a* and the side panel portions 700*g*.

A drooping portion 700*c* is formed on the other of the long sides of the flat panel portion 700*a*, and insertion slits 700*i*, into which the insertion flaps 700*j* are to be inserted, are formed in the drooping portion 700*c*.

Figure 8B:
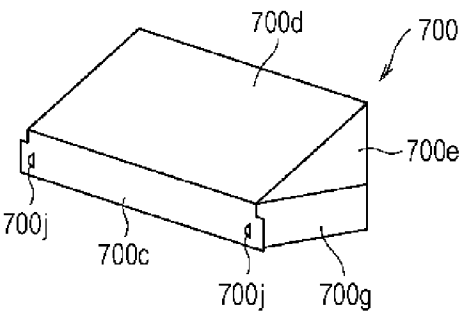

FIG. 8B is a perspective view of the packaging box closing member 700 that is made by folding the above-described corrugated paper along the alternate long and short dash lines and the broken lines and by inserting the insertion flaps 700*f* and 700*j* into the insertion slits 700*h* and 700*i*.

As necessary, a weight member may be disposed on the flat panel portion 700*a*.

Figure 9A:
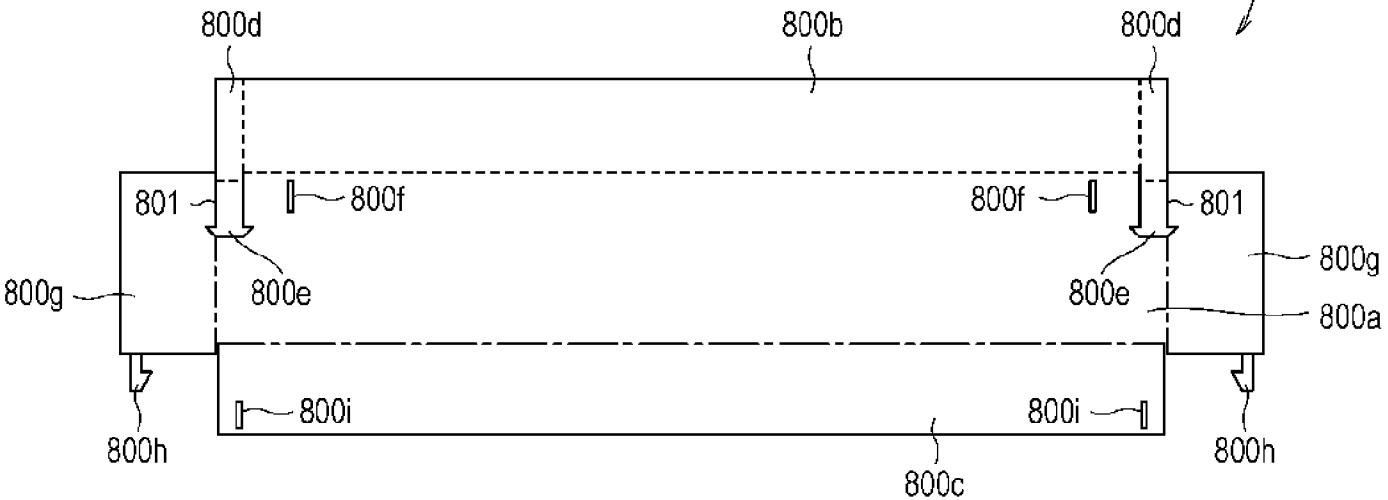
FIG. 9A is a developed view and FIG. 9B is a perspective view of an example of the packaging box closing member according to the exemplary embodiment.

FIG. 9A is a developed view of a packaging box closing member 800 in which an upright portion 800*b* is formed on one of the long sides of a rectangular flat panel portion 800*a*.

The left and right end portions of the upright portion 800*b* are support portions 800*d* that support the upright portion 800*b* when the end portions are folded.

On the flat panel portion 800*a* side of the support portions 800*d*, insertion flaps 800*e* are formed by cutting lines 801 in the flat panel portion 800*a*. Insertion slits 800*f*, into which the insertion flaps 800*e* are to be inserted, are formed in the flat panel portion 800*a*.

Side panel portions 800*g* are formed at the left and right ends of the flat panel portion 800*a*, and each of the side panel portions 800*g* has an insertion flap 800*h*.

A drooping portion 800*c* is formed on the other of the long sides of the flat panel portion 800*a*, and insertion slits 800*i*, into which the insertion flaps 800*h* are to be inserted, are formed in the drooping portion 800*c*.

Figure 9B:
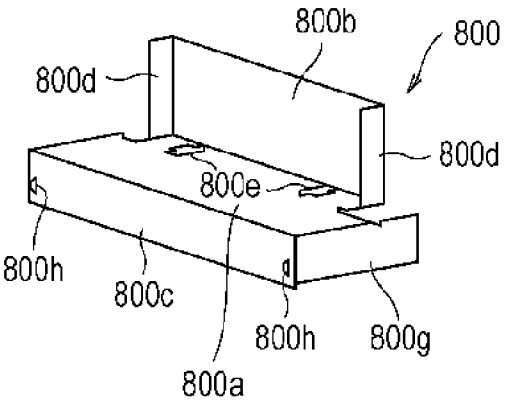

FIG. 9B is a perspective view of the packaging box closing member 800 that is made by folding the above-described corrugated paper along the alternate long and short dash lines and the broken lines and by inserting the insertion flaps 800*e* and 800*h* into the insertion slits 800*f* and 800*i*.

As necessary, a weight member may be disposed on the flat panel portion 800*a*.

Thus, the packaging box closing members 600, 700, and 800 are made at low cost by using corrugated paper, which is relatively low-cost.

A packaging box closing member according to the present invention is applicable to an operation of stacking packaging boxes containing electronic apparatuses or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packaging box closing system comprising:

a packaging box with a pair of unsealed lid portions, and a packaging box closing member having a flat panel portion that is placed on the pair of unsealed lid portions so as to intersect a closed portion formed by the pair of lid portions, the pair of lid portions being located on a top surface of the packaging box; and an upright portion that stands on a side of the flat panel portion, the side intersecting the closed portion, wherein, when stacking another packaging box on the top surface of the packaging box, a part of the another packaging box or a part of a transport device that transports the another packaging box contacts the upright portion, and the packaging box closing member is pushed toward an end of the top surface of the packaging box together with the flat panel portion and is dropped.

* * * * *